United States Patent [19]

Goodman

[11] Patent Number: 4,607,400

[45] Date of Patent: Aug. 26, 1986

[54] ASSEMBLY FOR UTILIZING BILGE PUMP AS POWER WATER JET

[76] Inventor: Steven Goodman, 85 Oak St., Norwood, N.J. 07648

[21] Appl. No.: 832,050

[22] Filed: Feb. 21, 1986

Related U.S. Application Data

[63] Continuation-in-part of Ser. No. 764,487, Aug. 12, 1985, Pat. No. 4,599,753.

[51] Int. Cl.[4] ..... A61H 33/02; E04H 3/18

[52] U.S. Cl. ..... 4/541; 4/542; 4/492; 4/496; 4/506; 128/66; 220/85 R

[58] Field of Search ..... 4/506, 507, 496, 492, 4/490, 542, 541, 543; 128/66; 220/85 R

[56] References Cited

U.S. PATENT DOCUMENTS

| | | | |
|---|---|---|---|
| 1,900,283 | 3/1933 | Weiss | 220/85 R |
| 2,100,186 | 11/1937 | Hagopian | 4/569 |
| 3,286,712 | 11/1966 | Roden | 128/66 |
| 3,476,106 | 11/1969 | Ritz et al. | 128/66 |
| 3,631,544 | 1/1972 | Tytel | 4/506 |
| 3,675,814 | 7/1972 | Graf | 220/85 R |
| 3,733,621 | 5/1973 | Jannuzzi, Jr. | 4/506 |
| 3,749,244 | 7/1973 | Jannuzzi, Jr. | 210/169 |
| 3,820,173 | 6/1974 | Weller | 4/492 |
| 4,439,876 | 4/1984 | Chalberg | 4/542 |

*Primary Examiner*—Henry K. Artis
*Attorney, Agent, or Firm*—Peter L. Berger

[57] ABSTRACT

A submersible bilge pump is used within a tub to provide a Jacuzzi-type jet spray. A mounting assembly enables the bilge pump to be located below the water in the tub, yet the mounting assembly allows for effective mounting to the tub to provide the water jet type action. The mounting assembly also allows for the submersible bilge pump to be rotatably fastened to the tub to provide a whirlpool type action when desired.

6 Claims, 3 Drawing Figures

ASSEMBLY FOR UTILIZING BILGE PUMP AS POWER WATER JET

This is a continuation-in-part of Ser. No. 764,487 filed Aug. 12, 1985, now U.S. Pat. No. 4,599,753.

BACKGROUND OF THE INVENTION

This invention relates to the conversion of standard tubs, whether portable or fixed to serve as whirlpool or Jacuzzi-type tubs.

Conventionally, Jacuzzi or whirlpool-type tubs are very expensive and require special construction. Special plumbing fixtures are required, and the entire assembly and costs diminishes the utilization of these type tubs.

An object of this invention is to provide an apparatus which converts ordinary portable, inflatable or fixed tubs to Jacuzzi or whirlpool type systems without requiring special plumbing.

Another object of this invention is to provide such a mounting system which is able to quickly and effectively be attached to conventional tubs.

Yet another object of this invention is to provide such an assembly which utilizes a battery driven submersible bilge pump, with the battery being of substantially low voltage so as to eliminate possibilities of shock or injury.

Still another object of this invention is to provide such an assembly which is adaptable to be attached to either conventional tubs as found in bathtubs or circular inflatable tubs which are generally used outdoors.

Yet another object of this invention is to provide such an assembly which enables the height of the bilge pump to be adjusted in the water so as to control the effect of the jet action.

Another object of this invention is to provide such an assembly in which the direction of the jet spray is adjusted so as to provide either a whirlpool or Jacuzzi-type arrangement.

Other objects, advantages and features of this invention will become more apparent from the following description.

SUMMARY OF THE INVENTION

In accordance with the principles of this invention, the above objects are accomplished by providing a mounting means for utilizing a submersible bilge pump in a tub of water, the mounting means comprising carrier means for carrying the bilge pump, the bilge pump having a spout and being attached to the carrier means permitting vertical positioning of the bilge pump at a desired level in the water, further comprising a reducer attached to the spout of the bilge pump to enhance the jet force emanating from the bilge pump. In one specific embodiment, the bilge pump is attached to a U-shaped channel or bracket which terminates in upper and lower flanges. This type of assembly is especially adapted to be used in a tub which has upper and lower retainers or holders molded into the inner wall of the tub. The bracket is flexible and is able to be flexed so as to allow the flanges to slip under the retainers. When the bracket is released, it will be fixedly held beneath the retainers because of the flanges being slipped into the retainers. An additional bracket is employed for attaching the bilge pump to the U-shaped bracket, and a slot is provided in the U-shaped bracket for this assembly. The bilge pump is battery driven, and a small electric battery is provided to allow the bilge pump to effectively and safely operate within the tub. A plurality of bilge pumps may be placed around the tub so as to provide a plurality of jet sprays.

As may be realized the conversion of a tub to a Jacuzzi is accomplished without the necesssity of special plumbing, and the use of the simple-battery driven submersible bilge pump allows a safe and effective conversion to be accomplished.

DETAILED DESCRIPTION

Figure 1:
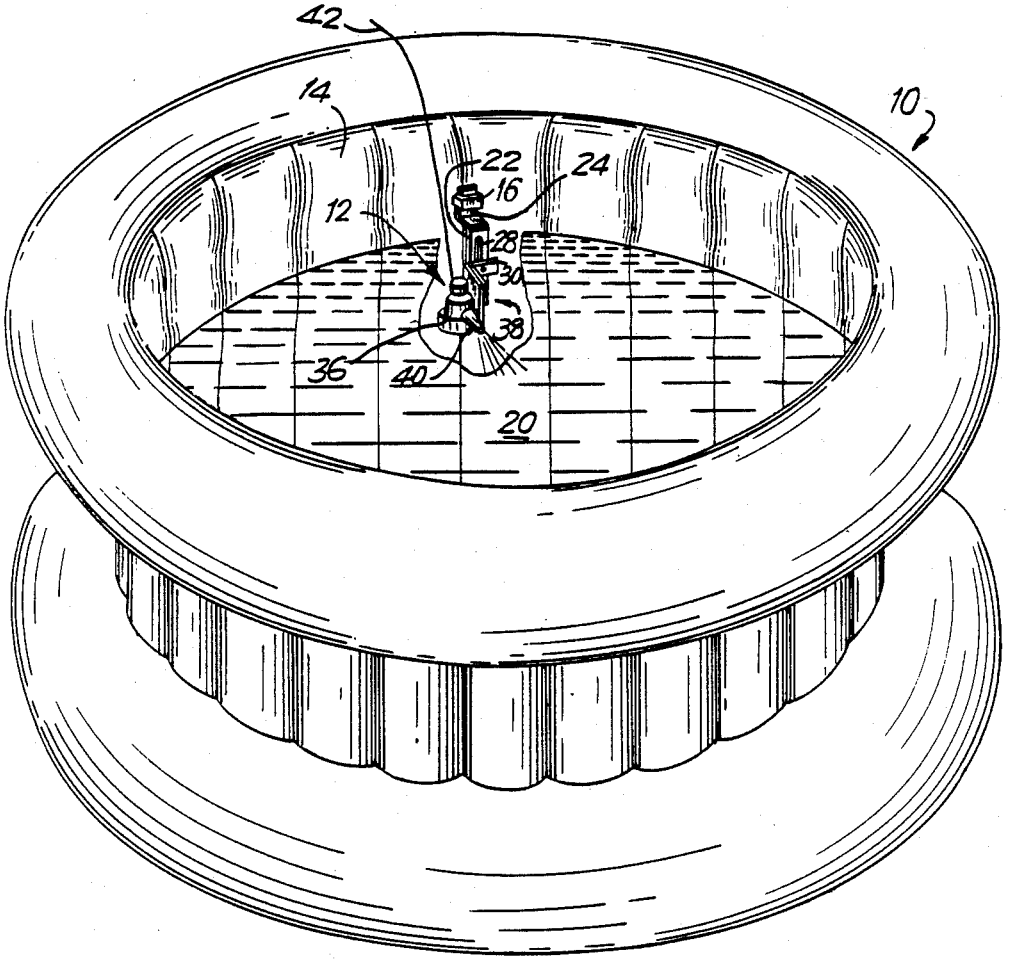
FIG. 1 is a perspective view showing a circular inflatable type tub with a plurality of jets attached to the mounting means of this invention.
Figure 3:
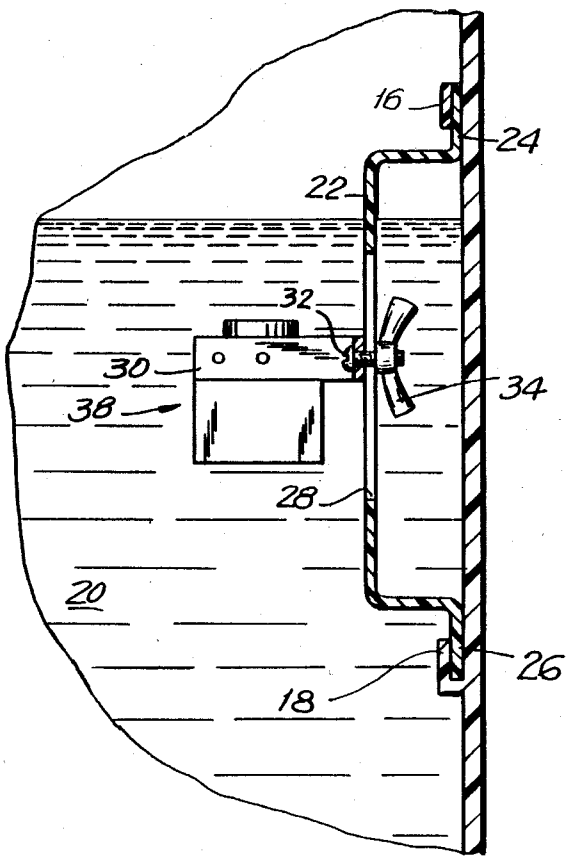
FIG. 3 is a sectional view along the wall of the circular tub showing the mounting means of this invention attached thereto.

FIG. 1 is a perspective view of a circular tub 10 which may be of an inflatable type. There is shown a plurality of water jets 12 attached to the inner wall 14 of the tub. Upper and lower spaced apart U-shaped retainers or guards 16 and 18 are attached to the inner wall of the tub. These may be attached at specific points around the periphery of the tub at desired locations. The tub will be filled with water 20 to an appropriate depth.

Figure 2:
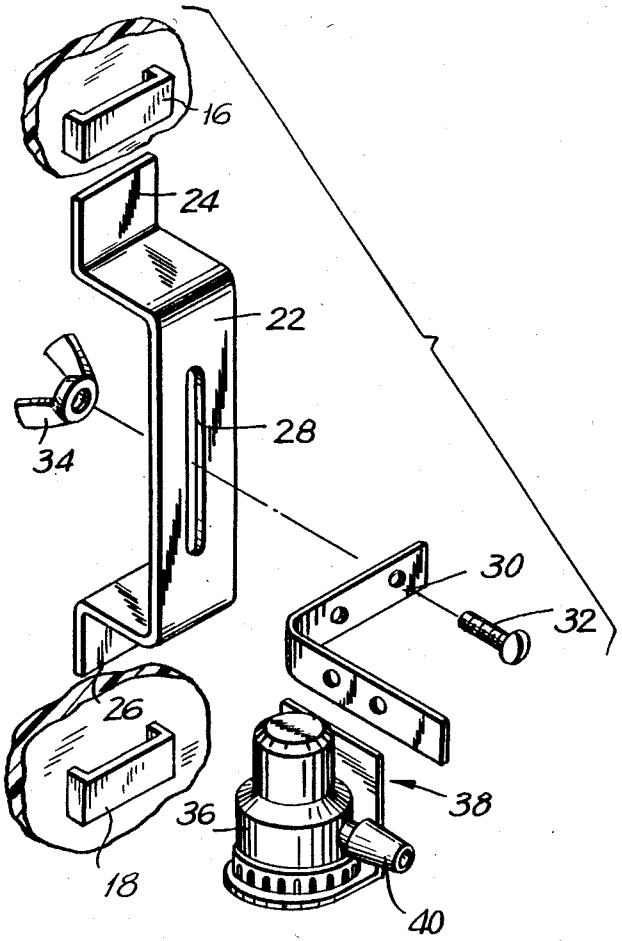
FIG. 2 is an exploded perspective view of one embodiment of this invention for use in the tub illustrated in FIG. 1.

FIG. 2 is an exploded perspective view of one embodiment of a mounting means for using the submersible pump to convert a tub of a Jacuzzi-type tub. There is shown a U-shaped channel or bracket 22 terminating in upper and lower flanges 24 and 26, the U-shaped bracket having a vertical slot 28 to which there is attached a bracket 30 by means of a screw 32 and wingbolt 34. A submersible bilge pump 36 is attached to the bracket 30 as at 38, and a reducer 40 is attached to the spout end of the bilge pump to enhance the jet flow emanating therefrom. The U-shaped bracket 22 is made of plastic, and the retainers 16 and 18 of the tub are able to accommodate flanges 24 and 26, respectively, thereunder. This is accomplished by flexing bracket 22 to slide the flanges 24 and 26 under retainers 16 and 18, respectively, and when the bracket is released, it will be firmly held between the retainers.

The bilge pump is operated by a battery-driven motor, and the battery-driven motor is a low DC voltage-type motor. An insulated wire 42 is attached to the pump and is carried outside of the tub to be attached to the portable battery located there. In this manner, the bilge pump can easily function as a power jet without requiring special plumbing. As may be readily understood, the position of the bilge motor with respect to the tub can be adjusted by raising or lowering the submersible pump as by adjusting bracket 30 in longitudinal slot 28.

As may be readily understood, this invention provides the means to convert standard tubs into whirlpools or Jacuzzis, without the addition of expensive plumbing. Further, the submersible bilge pump is battery driven, and the low voltage DC battery provides for safe operation. Additionally, due to the portablility of the carriers for the submersible bilge pumps, the location and positioning of the bilge pumps may be readily changed to suit the user's purposes, and there are no fixed plumbing or electrical installation which is required to be able to use applicant's novel invention.

The above invention has been described with several embodiments. Numerous changes and modifications from this invention may be made without departing from the spirit and teaching of this invention.

What is claimed is:

1. In combination, mounting means for attaching a submersible bilge pump and a tub of water, said bilge pump functioning as a water jet, said mounting means comprising carrier means for carrying said bilge pump, said bilge pump having a spout end being attached to said carrier means, said carrier means being attached to the tub, wherein said carrier means comprises a flexible U-shaped bracket terminating in upper and lower flanges, said tub comprising spaced apart retainers connected against the inner wall of said tub, said flexible U-shaped bracket being arched to draw said flanges toward each other to be attached in said retainers, said U-shaped bracket further comprising a vertical slot in a center portion thereof to which said bilge pump is vertically adjustably connected, said bilge pump being attached to said carrier permitting said vertical positioning of said bilge pump at a desired level in the water, further comprising a reducer attached to the spout of said bilge pump to enhance the jet force of the water pumped out of said bilge pump.

2. Mounting means as claimed in claim 1, further comprising a bracket attached to said slot and to said bilge pump.

3. Mounting means as claimed in claim 2, wherein said bilge pump is driven by a battery driven electric motor.

4. Mounting means as claimed in claim 1, further comprising a plurality of said bilge pumps mounted to said tub to provide jets of water perpendicular to the wall of said tub to form a Jacuzzi style tub.

5. Mounting means as claimed in claim 1, wherein said retainers are molded to the inner wall of said tub.

6. Mounting means as claimed in claim 4, wherein said plurality of bilge pumps are attached to said tub at said retainers.

* * * * *